US006591456B2

(12) United States Patent
DeLuca et al.

(10) Patent No.: US 6,591,456 B2
(45) Date of Patent: Jul. 15, 2003

(54) CUSHIONING DEVICE

(75) Inventors: Donald A. DeLuca, Guilford, CT (US); Michael Kent, Cheshire, CT (US); Richard C. O'Brien, Oxford, CT (US); Daniel A. Ferrara, Jr., Morris, CT (US)

(73) Assignee: BIC Corporation, Milford, CT (US)

( * ) Notice: Subject to any disclaimer, the term of this patent is extended or adjusted under 35 U.S.C. 154(b) by 0 days.

(21) Appl. No.: 09/900,915

(22) Filed: Jul. 9, 2001

(65) Prior Publication Data

US 2003/0005549 A1 Jan. 9, 2003

(51) Int. Cl.[7] ..... A45C 13/22; B25G 3/00

(52) U.S. Cl. ..... 16/431; 16/430; 16/DIG. 12; 16/421; 16/110.1

(58) Field of Search ..... 16/431, 430, 421, 16/DIG. 12, DIG. 18, DIG. 19, 444, 110.1; 81/489; 401/6; 15/143.1, 443; 267/141, 141.2, 141.4; 74/551.9, 558.5; 473/523, 302, 299, 300

(56) References Cited

U.S. PATENT DOCUMENTS

| | | | |
|---|---|---|---|
| 141,287 | A | 7/1873 | Orndorff |
| 255,961 | A | 4/1882 | Faber |
| 412,479 | A | 10/1889 | Davis |
| 544,990 | A | 8/1895 | Miller |
| 624,853 | A | 5/1899 | Oberbeck |
| 770,363 | A | 9/1904 | Goldsmith |
| 782,388 | A | 2/1905 | Goldsmith |
| 839,537 | A | 12/1906 | Beaumel |
| 1,868,441 | A | 7/1932 | Colfelt |
| 2,236,194 | A | 3/1941 | Lorber |
| 3,269,399 | A | 8/1966 | Smith |
| 3,518,786 | A | 7/1970 | Holtvoigt |
| 3,552,044 | A | 1/1971 | Wiele |
| 3,947,132 | A | 3/1976 | Fox |
| 4,038,762 | A | 8/1977 | Swan, Jr. |
| 4,098,506 | A | 7/1978 | Gaiser |
| 4,144,658 | A | 3/1979 | Swan, Jr. |
| 4,158,087 | A | 6/1979 | Wood |
| 4,167,347 | A | 9/1979 | Hoyle |
| 4,229,546 | A | 10/1980 | Swan, Jr. |
| 4,243,754 | A | 1/1981 | Swan, Jr. |
| 4,255,202 | A | 3/1981 | Swan, Jr. |
| 4,283,808 | A | 8/1981 | Beebe |
| 4,509,228 | A | 4/1985 | Landsberger |
| 4,588,229 | A | 5/1986 | Jay |

(List continued on next page.)

FOREIGN PATENT DOCUMENTS

| | | |
|---|---|---|
| DE | 1511325 | 7/1969 |
| JP | 02-41295 | 2/1990 |
| JP | 06-48086 | 2/1994 |

OTHER PUBLICATIONS

Dielectrics Industries, Catalog, "Creative Collaboration, design/development/manufacturing" (ca. 1998).

Dielectrics Industries, Website Print–outs (printed Jan. 2001).

*Primary Examiner*—Chuck Y. Mah

(74) *Attorney, Agent, or Firm*—Pennie & Edmonds, LLP

(57) ABSTRACT

The present invention relates generally to a cushioning device that is adapted to retain a flowable medium to provide a cushioning effect. The cushioning device has a cushioning member having a deformable bladder member defining a medium chamber and a flowable medium, such as a fluid, retained in the chamber. The cushioning member is adapted to be mounted onto an article to thereby provide a cushioning effect for a user. The cushioning device can optionally have a support element to provide an additional cushioning effect. The present invention also relates to a cushioned article that has a finger-held or finger-manipulated article on which the cushioning device is mounted to provide a comfortable finger grip for a user. The cushioned article is so formed that it can fit within the user's finger grip and that the inflated bladder member can be deformed by the user's fingers or fingertips.

26 Claims, 7 Drawing Sheets

U.S. PATENT DOCUMENTS 4,617,697 A * 10/1986 David ..... 16/421
4,660,238 A 4/1987 Jay
4,709,431 A 12/1987 Shaktman
4,726,624 A 2/1988 Jay
4,761,843 A 8/1988 Jay
4,911,569 A 3/1990 Hashimoto et al.
4,952,439 A 8/1990 Hanson
5,000,599 A 3/1991 McCall et al.
5,022,109 A 6/1991 Pekar
5,034,998 A * 7/1991 Kolsky ..... 2/22
5,058,291 A 10/1991 Hanson
5,074,765 A 12/1991 Pekar
H1050 H 5/1992 Petrillo
5,121,962 A * 6/1992 Weber et al. ..... 297/199
5,143,463 A 9/1992 Pozil et al.
5,144,705 A * 9/1992 Rogers ..... 5/654
5,144,708 A 9/1992 Pekar
5,147,685 A 9/1992 Hanson
5,158,767 A 10/1992 Cohen et al.
5,193,246 A 3/1993 Huang
5,274,846 A * 1/1994 Kolsky ..... 2/16
5,294,117 A 3/1994 Huang
5,335,907 A 8/1994 Spector
5,355,552 A 10/1994 Huang
5,372,487 A 12/1994 Pekar
5,427,577 A 6/1995 Picchietti et al.
5,496,244 A * 3/1996 Caruthers ..... 482/108
5,537,688 A 7/1996 Reynolds et al.
5,558,452 A 9/1996 Oka et al.
5,564,143 A 10/1996 Pekar et al.
5,603,118 A 2/1997 Solomon
5,638,565 A 6/1997 Pekar
D381,544 S 7/1997 Pekar
5,647,078 A 7/1997 Pekar
5,669,161 A 9/1997 Huang
D386,558 S 11/1997 Rietkerk
D387,601 S 12/1997 Pekar
5,701,635 A 12/1997 Hawkes
5,713,104 A 2/1998 Giampaolo, Jr.
D391,436 S 3/1998 Pekar
5,771,490 A 6/1998 Reynolds et al.
5,830,553 A * 11/1998 Huang ..... 36/29
5,845,364 A 12/1998 Chen
5,848,453 A * 12/1998 Racodon ..... 16/16
5,876,134 A 3/1999 Tseng et al.
5,926,901 A 7/1999 Tseng et al.
D414,807 S 10/1999 Baudino et al.
5,970,581 A 10/1999 Chadwick et al.
5,987,705 A 11/1999 Reynolds
6,082,683 A * 7/2000 Yates ..... 156/145
6,112,618 A * 9/2000 Yates ..... 16/DIG. 12
6,127,010 A * 10/2000 Rudy ..... 36/141
6,158,910 A * 12/2000 Jolly et al. ..... 16/430
6,161,240 A * 12/2000 Huang ..... 36/147
6,197,392 B1 * 3/2001 Jones ..... 16/DIG. 12
6,273,626 B1 8/2001 Yazawa ..... 401/6
6,428,865 B1 * 8/2002 Huang ..... 36/29

* cited by examiner

CUSHIONING DEVICE

FIELD OF THE INVENTION

The present invention relates generally to a cushioning device that is adapted to provide a cushioning effect for a user. More particularly, the present invention relates to a cushioning device that comprises a medium chamber for retaining a flowable medium, such as a fluid, to thereby provide a cushioning effect.

BACKGROUND OF THE INVENTION

Cushioning devices are generally used on various article handles to provide a cushioning effect for the user. However, depending on the specific application of a cushioning device, the technical problems and users' needs vary. Accordingly, cushioning devices are constructed differently to address the particular problems and needs.

Each of U.S. Pat. Nos. 5,355,552 and 5,193,246, issued to Ing-Chung Huang, discloses a shock absorbing device for use with impact articles. Impact articles typically include sports rackets, bicycle or motorcycle handles, steering wheels, hammers, and the like which are to be held by a user's entire hand during use to withstand impact or shock transmitted to or generated by the articles. The shock absorbing devices disclosed in these patents are constructed to be held by a user's hand to provide a cushion between an impact article and the user's hand thereby preventing impact from being transmitted to the user's hand during the use of the impact articles.

U.S. Pat. No. 5,294,117, issued to Ben Huang, also discloses a shock absorbing device for use with impact articles. The shock absorbing device is in the form of a resilient compressible body overlying the handle and includes an inflatable tube. When the tube is inflated, it defines a raised profile along the body adjacent the tube. The entire shock absorbing device is constructed to be held by a user's hand during normal use.

Moreover, U.S. Pat. No. 5,713,104, issued to Giampaolo, and U.S. Pat. No. 4,509,228, issued to Landsberger, each disclose a hand grip element. The hand grip element is intended to assist the manually impaired with retaining and using conventional implements including eating and cooking utensils, toothbrushes, writing implements, such as pens, and the like. When the hand grip element is inflated and thus expanded, it assumes an ergonomic shape and size compatible with a hand grip so that the manually impaired can easily hold the grip element with their hands.

Other cushioning devices are designed for placement on the gripping portion of finger-held or finger-manipulated articles to increase users' comfort during gripping of the articles. U.S. Pat. Nos. 5,926,901 and 5,876,134, issued to Tseng et al., and U.S. Pat. No. 4,283,808, issued to Beebe, describe foam grips. The foam grip is tubular and adapted to fit over a finger-held or finger-manipulated article, such as a pen or a toothbrush, to provide a comfortable grip for the user's fingers.

Furthermore, U.S. Pat. No. 5,000,599, issued to McCall et al., discloses a grip for use with a writing implement. The grip encloses a substance that can deform to conform to the shape of a user's fingers in response to the pressure applied by the fingers. However, the deformable substance in the McCall grip retains the deformed shape for at least about five seconds following release of the grip by the user before returning substantially to the initial shape. Consequently, the McCall grip is incapable of quickly resume its initial shape to respond to changing deforming forces. Thus, although the McCall grip conforms to the user's grip, it does not provide much cushioning.

SUMMARY OF THE INVENTION

The present invention relates generally to a cushioning device that is adapted to retain a flowable medium, such as a fluid (e.g., gels, liquids, or gases), therein to provide a cushioning effect in response to a deforming force. The cushioning device has a deformable bladder member, which at least partially defines a medium chamber for retaining a flowable medium, such as a fluid, therein to provide a cushioning effect.

In accordance with one aspect of the invention, the cushioning device can be mounted on a finger-held or finger-manipulated article to provide a comfortable finger grip for a user. According to the present invention, finger-held or finger-manipulated articles can include, but are not limited to, writing implements, shavers, razors, toothbrushes, eating utensils, precision instruments, scissors, and the like. The cushioning device is so formed that, when the chamber is filled, the bladder member can fit within the user's finger grip and be deformed by the user's fingers or fingertips. Moreover, the chamber is filled such that the cushioning device can resist deforming forces applied thereto. Thereby the cushioned article is capable of conforming to the user's grip, for ergonomic purposes, while also providing cushioning effect to the user's fingers or fingertips.

In accordance with a separate, different aspect of the present invention, the inventive cushioning device can optionally incorporate a support element to provide an additional or modified cushioning effect than afforded by the bladder member and/or the flowable medium. The support element can be in the form of a deformable insert member positioned in the chamber to support the bladder member from within. The insert member can be sized and shaped to fill a substantial portion of the entire chamber to support the bladder member independently from the flowable medium. When the cushioning device is subjected to a deforming force, the insert member can deform along with both the bladder member and the flowable medium yet provide support to thereby provide a cushioning effect in addition to that provided by the bladder member and the flowable medium. The insert member can be formed of a less deformable material and thus be capable of resisting the deformation of the bladder member to thereby stabilize the same.

The optional support element can alternatively or additionally be positioned outside the chamber and have a different deformability from that of the inflated bladder member. Accordingly, the support element can independently provide a different cushioning effect from that of the inflated bladder member when the cushioning device is subjected to a deforming force. The support element can be formed of a material less deformable than the inflated bladder member and can be positioned in contact with the bladder member. When the bladder member is subjected to a deforming force, the support element is capable of restraining the deformation of the bladder member and thereby stabilizing the same. As a result, the cushioning device is capable of providing a comprehensive cushioning effect generated by the deformable bladder member, the flowable medium, and the support element, individually or combined.

These and other features and advantages of the present invention will be readily apparent from the following detailed description of the invention, the scope of the invention being set out in the appended claims.

BRIEF DESCRIPTION OF THE DRAWINGS

The detailed description of the present invention will be better understood in conjunction with the accompanying drawings, wherein like reference characters represent like elements, as follows.

DETAILED DESCRIPTION OF THE INVENTION

Exemplary cushioning devices and cushioned articles embodying the principles of the present invention are shown throughout the drawings and will now be described in detail. In the following description of various embodiments of cushioning devices and cushioned articles, similar elements or components thereof are designated with reference numbers having the same last two digits; redundant description is omitted.

Figure 1:
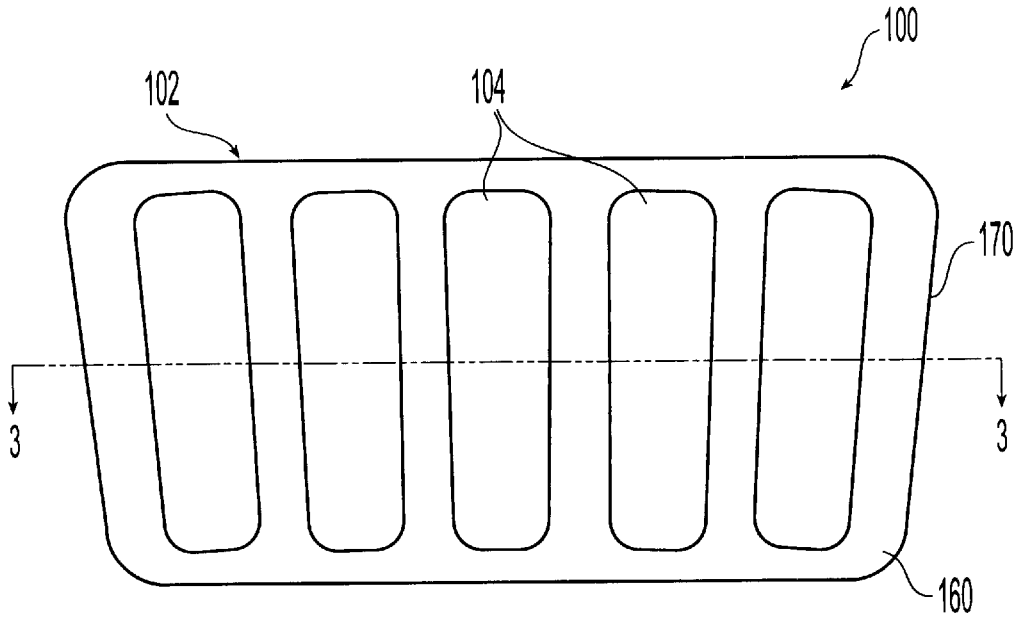
FIG. 1 is plan view of a cushioning device formed in accordance with the principles of the present invention.
Figure 2:
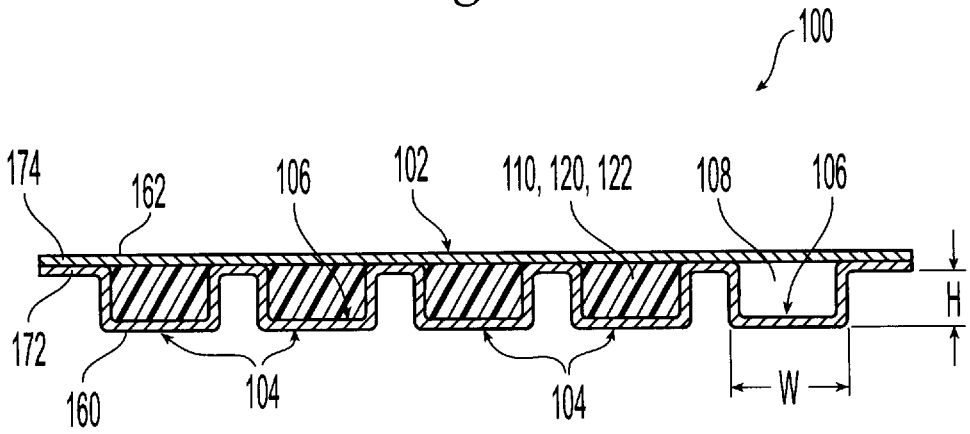
FIG. 2 is a transverse cross-section of the cushioning device of FIG. 1 showing support elements; one of the support elements is removed in order to show the chamber and the flowable medium enclosed therein.
Figure 3:
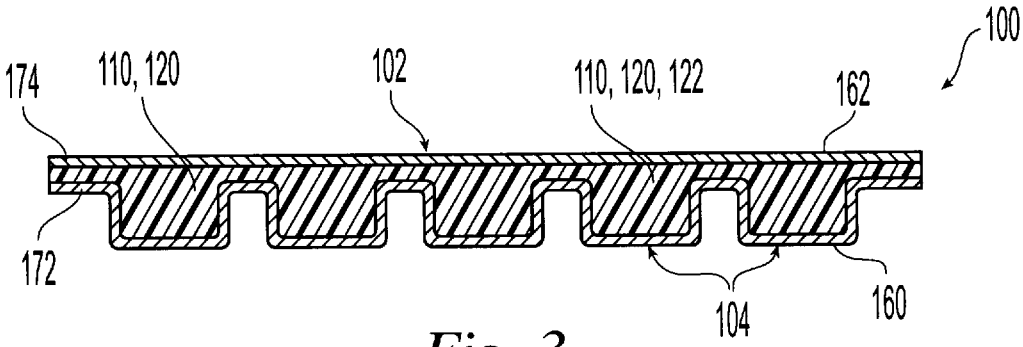
FIG. 3 is another transverse cross-section of the cushioning device of FIG. 1.

FIGS. 1 to 3 depict an exemplary cushioning device 100 comprising a cushioning member 102 formed according to the present invention. Cushioning member 102 can include a bladder member 104 which is capable of providing a cushioning effect upon application of a deforming force. For example, bladder member 104 can be formed of flexible and/or resilient material that is capable of deforming to thereby provide a cushioning effect independently of other elements of cushioning device 100. Deformable bladder member 104 can at least partially define a medium chamber 106 therein for retaining a flowable medium 108, such as a fluid (e.g., liquid or gas). Flowable medium 108 can also afford a desired cushioning effect independently of other elements of cushioning device 100. In one embodiment, bladder member 104 can be formed of a fluid-tight material to enclose fluid medium 108 therein. Such fluid-tight bladder member 104 is capable of interacting with flowable medium 108 to provide a combined cushioning effect.

As will be described in detail below as a separate and independent aspect of the present invention, a support element 110 can be employed in cushioning device 100. Support element 110 can be formed in various manners to afford an additional cushioning effect. Accordingly, cushioning device 100 of the present invention is capable of providing a comprehensive cushioning effect resulting from deformable bladder member 104, flowable medium 108, and/or support element 110, each capable of providing separate and independent cushioning effects.

Figure 4:
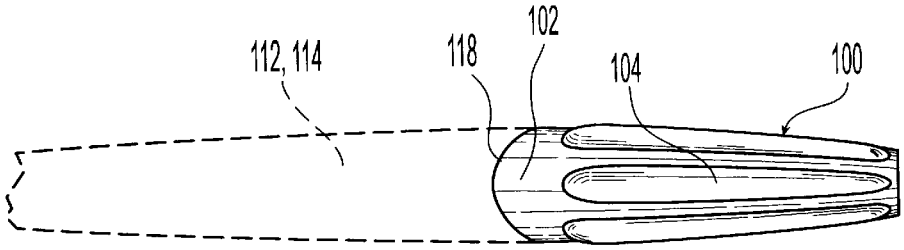
FIG. 4 is a side view of a cushioning device of the present invention showing the cushioning device adapted to be mounted on a hand-held or finger-held article.
Figure 5:
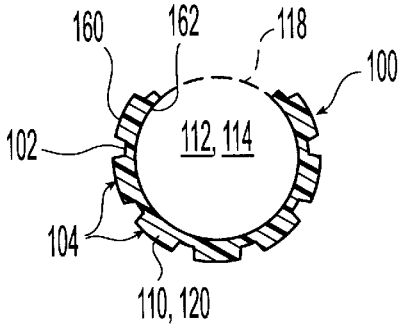
FIG. 5 is a cross-section of another cushioning device adapted to be mounted on a hand-held or finger-held article.

According to another, separate aspect of the present invention, an air-filled cushioning device 100 can be provided a finger-held or finger-manipulated article 112, such as shown in FIG. 4, to thereby afford a comfortable grip for the user's fingers when grasping or manipulating finger-held or finger-manipulated article 112. Cushioning device 100 may only partially wrap around finger-held or finger-manipulated article 112. For instance, cushioning device 100 may form a C-shape in cross-section, such as shown in FIG. 5, and be mounted on article 112 in various manners as will be described in greater detail below. Alternatively, cushioning device 100 may wrap completely around finger-held or finger-manipulated article 112, such as illustrated in FIGS. 7 to 9 and 13, and be mounted on article 112 in various manners as will be described in greater detail below.

In the present invention, finger-held or finger-manipulated article 112 (referenced herein as only "finger-held" for the sake of simplicity and not for limiting purposes) can be configured for grasping and/or manipulation by a user's fingers during its ordinary use and typically receives pressure or force applied by a user's fingers or fingertips. Exemplary finger-held or finger-manipulated articles 112 include, but are not limited to, writing implements, shavers, razors, toothbrushes, eating utensils, precision instruments, scissors, and the like. According to the present invention, finger-held or finger-manipulated articles 112 are to be distinguished from "hand-held" articles 114 which are intended to be held by a user's hand (in contrast to only the fingers) under a normal use circumstance. Examples of hand-held articles 114 can include, but are not limited to, sports rackets, sports equipment handles (e.g., bicycle or motorcycle handles), steering wheels, tools (e.g., hammers), cooking utensils, and the like.

When used on a finger-held or finger-manipulated article 112, such as shown in FIG. 4 or 5, cushioning device 100 of the present invention is adapted to fit within a user's finger grip during any ordinary use of finger-held or finger-manipulated article 112 to provide a comfortable finger grip. Cushioning device 100 can be so sized that it can comfortably fit within a user's finger grip after bladder member 104 is inflated. When the user holds finger-held or finger-manipulated article 112 during its ordinary use, the inflated bladder member 104 is capable of deforming to conform to the user's fingers or fingertips and distributing the pressure applied thereon to eliminate pressure points that could otherwise be felt by the user. Thus, bladder member 104 can provide an ergonomic feel for the user's fingers or fingertips and/or thus reduce the user's finger fatigue from prolonged use of finger-held or finger-manipulated articles 112. The use of an air-filled cushioning device 100 provides a comfortable, supportive, yet cushioning grip area which does not bottom out and which readily conforms to the user's fingers.

Figure 6:
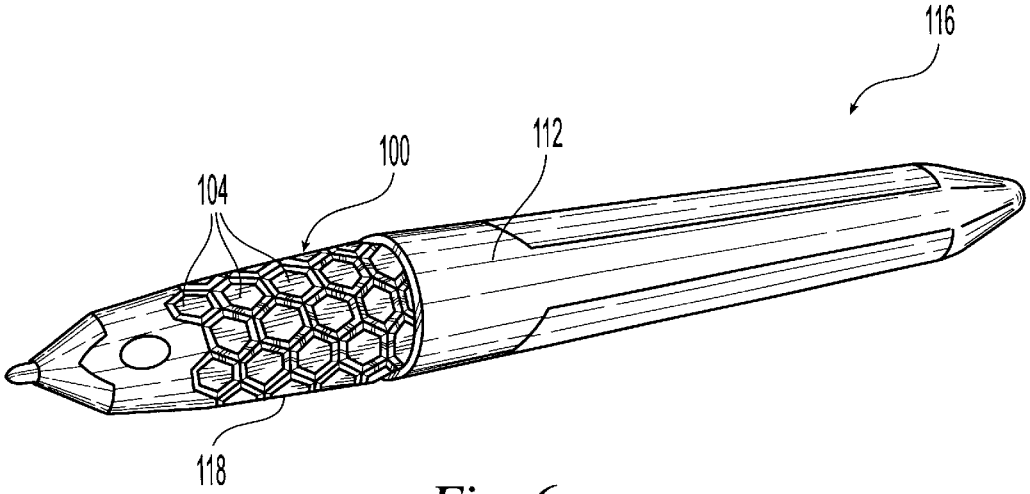
FIG. 6 is perspective view of a cushioned article formed in accordance with the principles of the present invention.

FIG. 6 illustrates an exemplary cushioned article 116 formed in accordance with the principles of the present invention. Cushioned article 116 can include a finger-held or finger-manipulated article 112 and an air-filled cushioning device 100 mounted on such finger-held or finger-manipulated article 112 to provide a cushioning effect therefor. For example, finger-held or finger-manipulated article 112 can have a grip portion 118, on which cushioning device 100 is placed and/or mounted.

According to another, separate aspect of the present invention, cushioning device 100 can comprise a support element 110 which is capable of providing an additional cushioning effect other than that afforded by bladder member 104 and/or flowable medium 106. Support element 110 can accomplish this task by modifying and/or enhancing the cushioning effect of bladder member 104 and/or flowable medium 108, such as by supporting bladder member 104 and/or regulating the flow of medium 108. Additionally or alternatively, support element 110 can provide an independent cushioning effect different from that of inflated bladder member 104. As a result, the combination of deformable bladder member 104, flowable medium 108, and support element 110 can provide a comprehensive cushioning effect for a user compared with the cushioning effect provided by any element alone.

Support element 110 can interact with deformable bladder member 104 and/or flowable medium 108 in various manners. For example, support element 110 can be formed so that it can be in contact with inflated bladder member 104 during its deformation. Accordingly, when deformable bladder member 104 is subjected to a deforming force, support element 110 can assist bladder member 104 in withstanding the deforming force and vary the degree of deformation of the inflated bladder member 104. In one embodiment, support element 110 can be formed to be less deformable than inflated bladder member 104 so that it will deform to a lesser degree than the inflated bladder member 104 after being subjected to a deforming force. As a result, support element 110 can stabilize inflated bladder member 104 to thus minimize or prevent any inadvertent lateral or other relative movement between the inflated bladder member 104 and an underlying article. In another embodiment, support element 110, when positioned inside chamber 106, can function to regulate the movement of flowable medium 108 to thereby modify the cushioning effect thereof.

Additionally or alternatively, support element 110 can be constructed separately and independently from deformable bladder member 104 and/or flowable medium 108. For example, support element 110 can be formed to have a different degree of deformability from that of the inflated bladder member 104 to thereby provide a different and/or independent cushioning effect for a user. Thereby, support element 110 can provide a user with a cushioning effect that is different and independent from inflated bladder member 104.

As another, separate feature, support element 110 can be contoured in accordance with, for example, a user's finger grip. Accordingly, support element 110 can provide an ergonomic support for the user.

Figure 13:
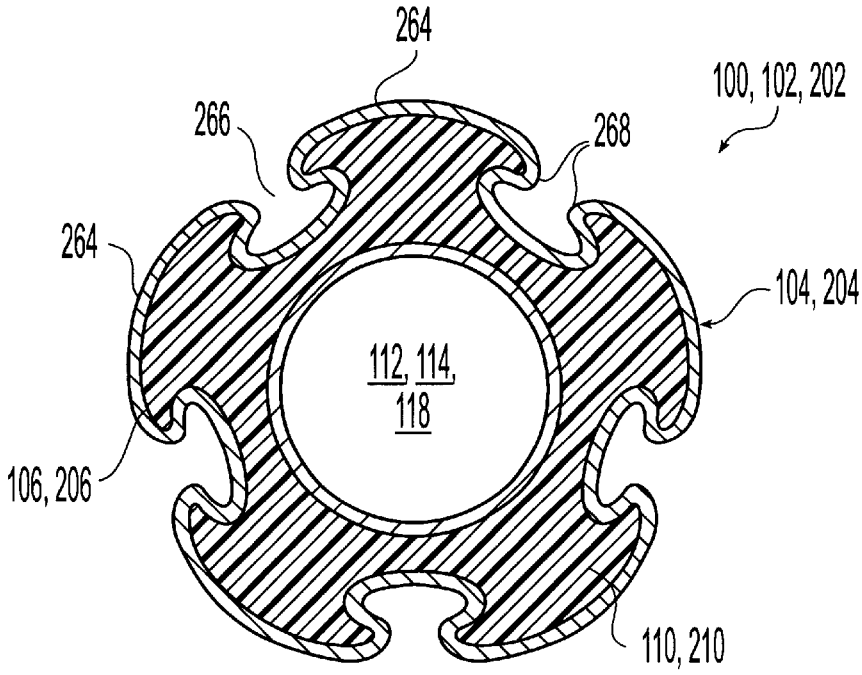
FIG. 13 is a cross-section of an alternative bladder member.

In exemplary embodiments shown in FIGS. 2, 3, and 13, support element 110 can be in the form of an insert member 120 adapted to fit within chamber 106. Insert member 120 can be formed of any material capable of deforming and/or yielding to a deforming force. Accordingly, insert member 120 can deform along with bladder member 104 and flowable medium 108, upon the application of a deforming force, to thus provide a cushioning effect in addition to that afforded by inflated bladder member 104. Optionally, insert member 120 can comprise a resilient material. The resilience of insert member 120 is capable of providing a counterforce against deforming forces to thereby provide an independent cushioning effect for the user.

In one embodiment, insert member 120 can be a foam member 122 made of any type of foam material, such as open-cell or closed-cell foams. For example, the material of foam member 122 can be determined based on the resilience suitable for insert member 120. In one embodiment, foam member 122 can be made of an open-cell foam which typically comprises a plurality of micro open-cells of different size. The open-cells can contain a medium, such as a fluid, therein and/or permit the same to flow therethrough. In another embodiment, foam member 122 can be made of an open-cell polyurethane foam to effectively retain flowable medium 108 in chamber 106.

In another embodiment, insert member 120 can be formed of a thermoplastic material so that it can be compatible and be joined with bladder member 104 by a heat sealing process. It will be appreciated that other materials can be used to form insert member 120 and are also within the scope of the present invention. Exemplary materials suitable for insert member 120 include, but are not limited to, synthetic and natural rubber, polyester, polyurethane, nylon, leather, textiles, elastomer and plastic reinforced textiles, elastomers (e.g., thermoplastic elastomers), resins (e.g., thermoplastic resins), and the like.

In an exemplary embodiment, insert member 120 can be formed to fill substantially the entire chamber 106. In one embodiment of FIG. 2, insert member 120 can be freely positioned inside chamber 106 without being attached to any other components. In this manner, insert member 120 can move freely and deform in all directions inside chamber 106 in response to a deforming force exerted in any direction. Accordingly, insert member 120 is capable of providing a cushioning effect to a user regardless of the direction from which the deforming force is applied.

Alternatively, insert member 120 can be at least partially secured to a portion of deformable bladder member 104 as shown in FIG. 3. Insert member 120 can be at least partially secured to deformable bladder member 104 in various manners, such as ultrasonic, kinetic, or other form of welding, heat sealing, adhesion (e.g., through application of any type of adhesive), mechanical couplings (e.g., fasteners), or the like. In one embodiment, insert member 120 can be formed of a material compatible with that of cushioning member 102, such as a thermoplastic material, to facilitate the manufacture of cushioning device 100. Accordingly, insert member 120 can be integrally joined with cushioning member 102 during the manufacture of cushioning device 102, as will be discussed in greater detail below. It will be appreciated that other embodiments of insert element 120 are also within the scope of the present invention.

In another exemplary cushioning device 200, as shown in FIGS. 7 to 13, support element 210 can be formed as an external element 230, which can be positioned outside chamber 206 and still provide a modified, enhanced, and/or independent cushioning effect. External element 230 can be more rigid than bladder member 204 so that the user can use external element 230 for additional support. Additionally or alternatively, external element 230 can be located close to or against bladder member 204. Being so formed, external element 230 is capable of assisting in stabilizing bladder member 204 from shifting or other inadvertent movement in relation to the rest of cushioning member 202 after bladder member 204 is subjected to deforming forces to thereby provide an additional cushioning effect.

Additionally or alternatively, external element 230 can be contoured to conform to a user's body portion that bladder member 204 contacts. In an exemplary embodiment where cushioning device 200 is used in connection with a finger-held article 212, external element 230 can be contoured ergonomically to conform to the shape of a user's finger. Accordingly, contoured external element 230 can independently or additionally provide a cushioning effect for the user.

External element 230, when provided external to chamber 206, can be formed either together with or separately from cushioning member 202. In one embodiment, external element 230 can be formed by a portion of cushioning member 202. For example, external element 230 can be integrally molded with bladder member 204. In another embodiment of FIGS. 7 to 9, external element 230 can be formed by an extension member 232 formed at a free end 234 of cushioning member 202 in various manners. For example, extension member 232 can be folded or otherwise wrapped to itself forming an external element 230 at free end 234 of cushioning member 202. Alternatively, cushioning member 202 can comprise first and second extension members 232 adapted to join with each other in various manners to form external element 230.

Figure 7:
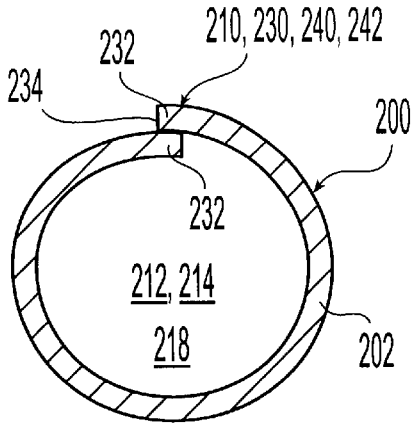
FIG. 7 is a cross-section of another cushioning device formed in accordance with the principles of the present invention with a support element.
Figure 8:
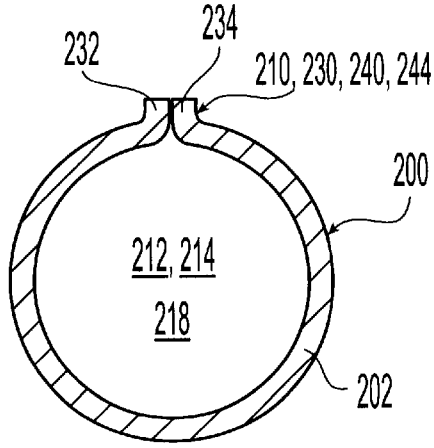
FIG. 8 is similar to FIG. 7 but shows an alternative support element.

For example, external element 230 can be formed by a seal member 240 formed by first and second extension members 232. In an exemplary embodiment, first and second extension members 232 can be overlapped with each other in various manners and/or joined to each other such as to form a lap seal 242 or a pinch seal 244 as shown in FIG. 7 or 8. In one embodiment, seal member 240 can be formed so that it can be in direct contact with bladder member 104. When seal member 240 is formed to be less deformable than inflatable bladder member 104, seal member 240 can stabilize bladder member 204 from inadvertent lateral movement. In another embodiment of FIG. 7, seal member 240 can be modified to provide an additional cushioning effect. For example, seal member 240 can be at least partially covered by a cover element 246, such as a stability bar. If desired, cover element 246 can be cushioned and/or contoured to further enhance the cushioning and/or support afforded by seal member 240 and cover element 246. In such an embodiment, seal member 240 can also assist in mounting cushioning member 202 onto an underlying article, as discussed below. It will be appreciated that other embodiments of seal element 240 are also within the scope of the present invention.

Additionally or alternatively, external element 230 can be formed as a frame member 250 and positioned directly against a portion of bladder member 204 to support the same. Frame member 250 can be made of various materials, such as a substantially rigid material. Accordingly, when bladder member 204 deforms in response to a deforming force, frame member 250 can restrain bladder member 204 against rolling, shifting, or other inadvertent movement in relation to frame member 250. Thus, frame member 250 can stabilize bladder member 204 after the same is subjected to deforming forces. In another embodiment, frame member 250 can be contoured and/or covered with a material, such as a resilient material (e.g., an elastomeric material) for an additional cushioning effect.

If desired, frame member 250 can be used to mount cushioning device 200 onto an underlying article. In one embodiment, frame member 250 can be at least a portion of a rigid body member 252 on which cushioning member 202 is mounted to provide a cushioning effect. For example, frame member 250 can be the gripping portion 218 of a finger-held article 212 or a hand-held article 214 as will be described later. Frame member 250 can also be other types of framework for various types of body cushions, such as a mattress, a seat or back cushion, or the like. In one embodiment, frame member 250 can be adapted to fit over cushioning member 202 to support bladder member 204. For example, frame member 250 can define at least one aperture 254 therein, which can be contoured to conform to the profile of bladder member 204 to accommodate the same. Accordingly, when bladder member 204 deforms after being subjected to a deforming force, frame member 250 can support bladder member 204 to provide an additional cushioning effect.

Figure 10:
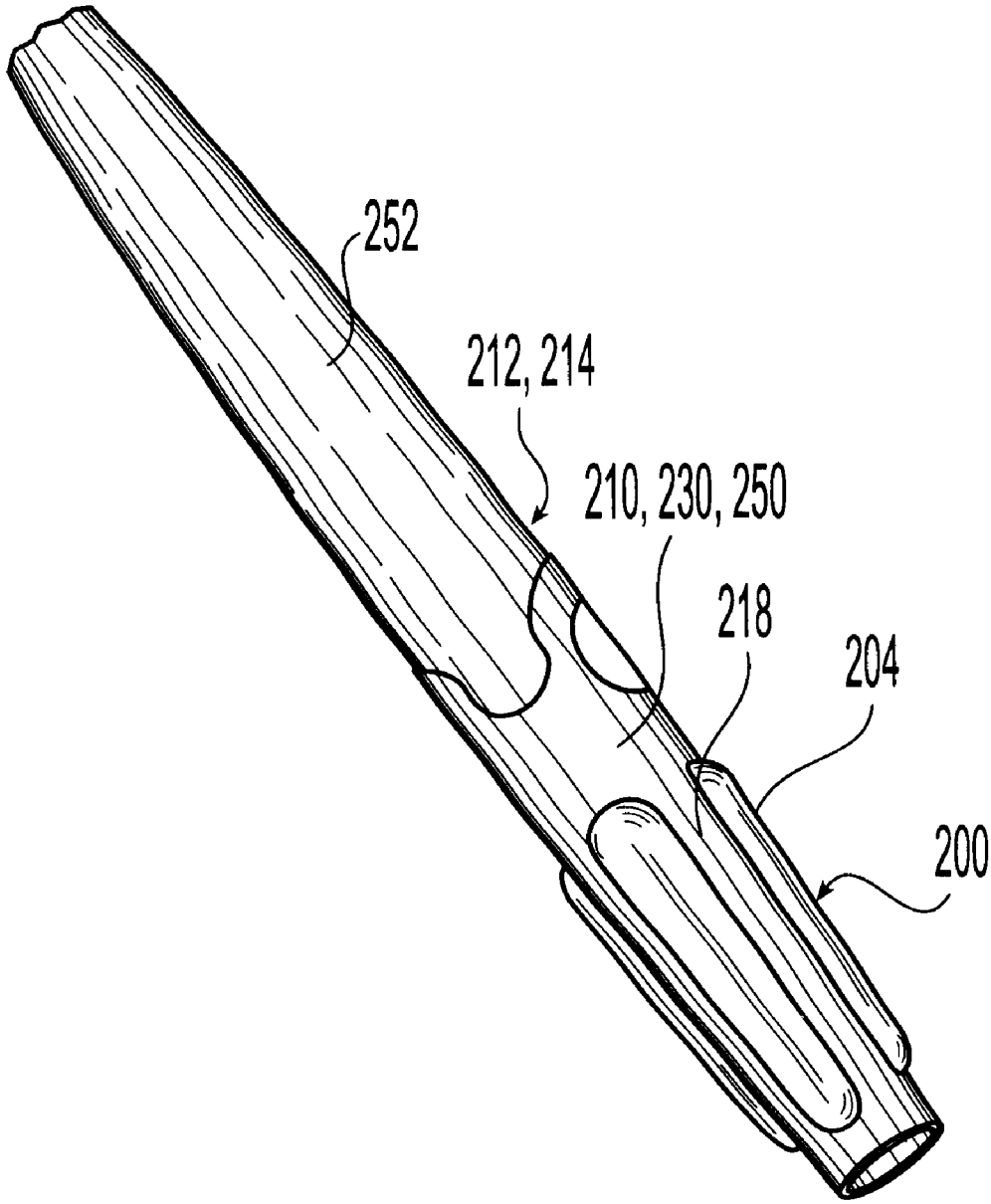
FIG. 10 is perspective view of another cushioning device formed in accordance with the principles of the present invention.
Figure 11:
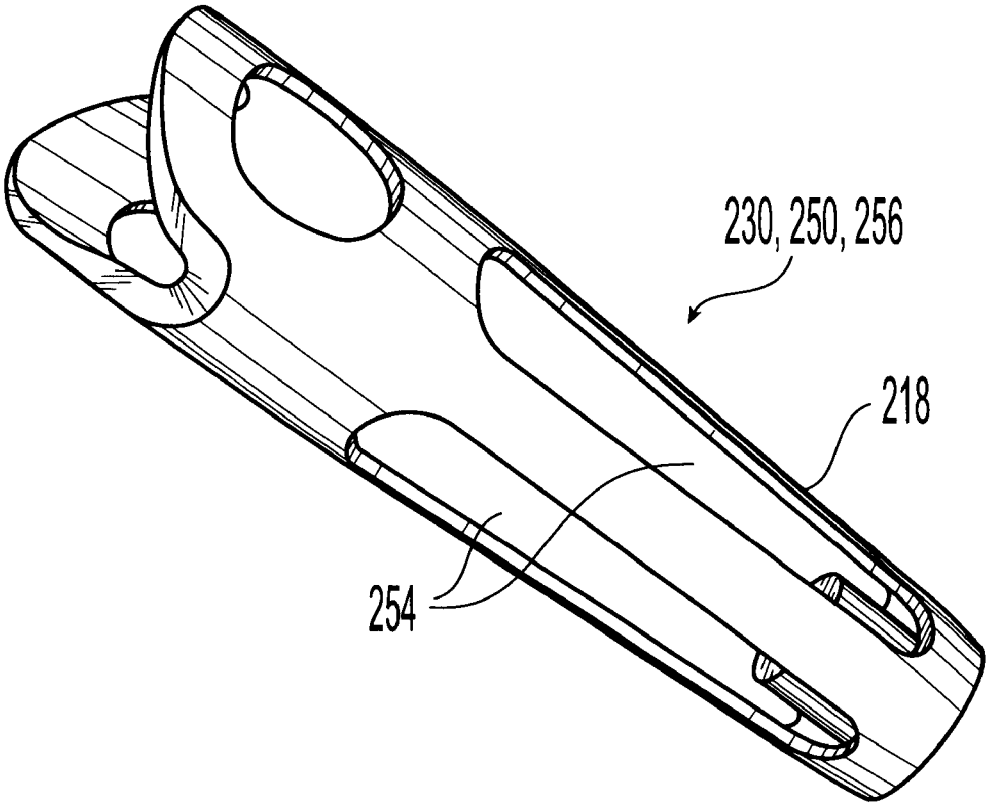
FIG. 11 is a perspective view of the support element of the cushioning device of FIG. 10.
Figure 12:
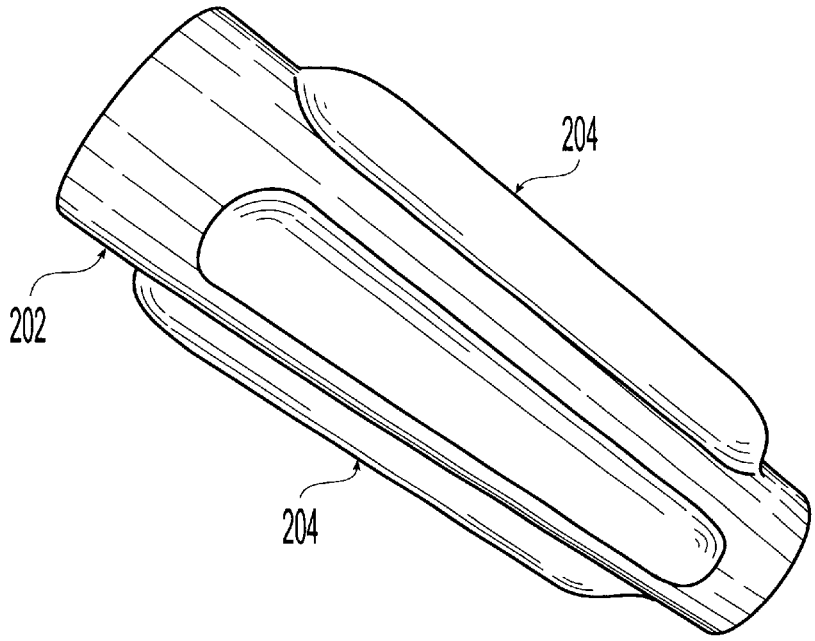
FIG. 12 is a perspective view of the bladder member of the cushioning device of FIG. 10.

In the embodiment of FIGS. 10 and 11, frame member 250 can be formed as a barrel member 256 and/or otherwise formed as grip portion 218 of finger-held article 212 or hand-held article 214. Barrel member 256 can define one or more apertures 254 contoured to fit around bladder member 204. Thereby, cushioning member 202 can be adapted to be mounted inside/underneath barrel member 256 with bladder member 204 fitting in and protruding outwardly through aperture 254. It will be appreciated that other embodiments of barrel member 256, frame member 250, or external element 230 are also within the scope of the present invention.

Under the principles of the present invention, cushioning member 102 can assume various forms depending on its applications. In one embodiment, such as shown in FIGS. 1 to 3, cushioning member 102 can comprise two opposing surfaces 160, 162. One of the opposing surfaces, such as 160, can be constructed for contacting a user. In one embodiment, user-contacting surface 160 can form at least a portion of bladder member 104 as will be described in detail below. The other surface, such as 162, of cushioning member 102 can be adapted for mounting onto an article to provide a cushioning effect thereto.

Cushioning member 102 can be adapted to be mounted on finger-held article 112 or hand-held article 114, such as shown in FIG. 4, to provide a cushioning grip to a user's fingers, fingertips, or hand. In one embodiment, cushioning member 102 may only partially wrap around finger-held article 112 or hand-held article 114. In such an embodiment, the exterior surface of cushioning member 102 can constitute a user-contacting surface 160. The interior surface of cushioning member 102 can be adapted for mounting cushioning member 102 onto finger-held or finger-manipulated article 112 in various manners, such as adhesion (e.g., through application of any type of adhesive), mechanical couplings (e.g., screws, clamps, or other fasteners), kinetic or other form of welding, or the like. In an exemplary embodiment, such as shown in FIG. 5, cushioning member 102 only partially wraps around grip portion 118 of finger-held article 112 or hand-held article 114 to form a C-shape in a cross-section. The C-shaped cushioning member 102 can, for example, be clipped onto finger-held article 112 or hand-held article 114 through an elastic clamping members separately or integrally formed with cushioning member 102.

Figure 9:
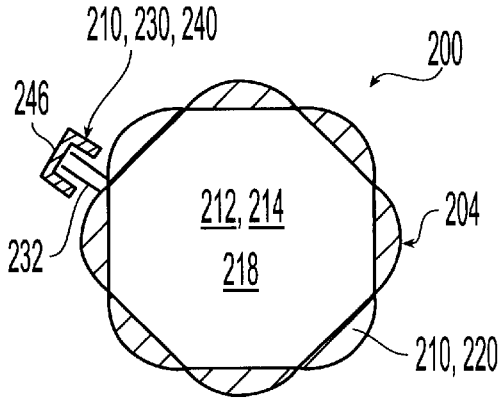
FIG. 9 is similar to FIG. 7 but shows an alternative support element.

In another embodiment, cushioning member 202 can completely wrap around finger-held article 212 or hand-held article 214, such as shown in FIGS. 7 to 9 and 13. In exemplary embodiments, such as shown in FIGS. 7 to 9, cushioning member 202 can be capable of assuming a sleeve shape to conform with grip portion 218 of finger-held article 212 or hand-held article 214 and be mounted thereon in a similar manner as discussed above. Additionally or alternatively, cushioning member 202 can be mounted on finger-held article 212 or hand-held article 214 through a seal member 240 formed by overlapping and joining first and second extension members 232 of cushioning member 202. In another exemplary embodiment, such as shown in FIG. 13, cushioning member 102 can be formed as a sleeve member that can snugly fit over grip portion 118 of finger-held article 112 or hand-held article 114 and be mounted thereon by friction. It will be appreciated that other embodiments of mounting cushioning member 102 over various underlying articles are also within the scope of the present invention.

Additionally or alternatively, cushioning member 102 can have different sizes. In the embodiment where cushioning device 100 is formed to fit onto a finger-held or finger-manipulated article 112, bladder member 104 can be sized to fit within a user's finger grip, as described above. It will be appreciated that other configurations of cushioning member 102 are within the scope of the present invention.

Bladder member 104 can be formed in various manners on, such as, user-contacting surface 160 of cushioning member 102. Bladder member 104 can define one or more chambers 106 therein for retaining flowable medium 108 to thereby afford a cushioning effect for the user. In a preferred embodiment, bladder member 104 can be formed to seal flowable medium 108 within chamber 106 and to prevent flowable medium 108 from escaping chamber 106, as will be further described below. Accordingly, bladder member 104 can assist flowable medium 108 in fulfilling and maintaining its cushioning effect.

As will be appreciated from the above descriptions, the materials forming any or all of the elements of cushioning device 100 may be selected from any of a number of materials having different properties to thereby optimize the cushioning effect thereof. In one embodiment, cushioning member 102 and bladder member 104 can be formed from the same material. Thus, for the sake of brevity, the following description is directed to only bladder member 104.

Deformable bladder member 104 can be formed of various materials that are capable of providing a cushioning effect. In an exemplary embodiment, bladder member 104 can be formed of a flexible material that can deform and/or yield to a deforming force applied thereto. When being subjected to a deforming force, bladder member 104 can deform in response to and thus yield to the deforming force, which can further cause the encased medium 108 to flow within chamber 106 to yield to the deforming force. The deformation of bladder member 104 and the movement of flowable medium 108 within chamber 106 result in a cushioning effect. In an exemplary embodiment, bladder member 104 can comprise any pliable material so that bladder member 104 can deform once being subjected to a deforming force and retain the deformed shape until bladder member 104 is subjected to another deforming force. It is therefore preferred that bladder member 104 be made of a flexible material capable of repeated deformation in response to repeated application and/or removal of deforming forces.

Optionally, bladder member 104 can comprise a resilient material. In addition to deformation upon application of a deforming force thereto, bladder member 104 may exert a counter force to the deforming force. Thus, the resilience of the material of bladder member 104 may add to the cushioning effect of cushioning device 100. It is also possible that a resilient bladder member 104 may have a tendency to resume its initial configuration after being subjected to a deforming force. Accordingly, once the deforming force is no longer applied, such a resilient bladder member 104 is capable of resuming its initial shape and being ready for the next application of a deforming force.

In another embodiment, bladder member 104 may comprise tactile enhancement. For example, bladder member 104 can be formed of a material that can provide the user with both a desirable tactile sensation as well as a useful function, such as non-slipperiness or softness, during the cushioning process. Additionally or alternatively, bladder member 104 may be physically configured or shaped to enhance tactile comfort beyond properties or characteristics imparted to such surface by the nature of the material itself. For instance, the surface of bladder member 104 may be textured, roughened, or otherwise not smooth to affect the overall tactile sensation imparted by bladder member 104 and/or to reduce possible slipperiness during the cushioning action.

Exemplary materials for bladder member 104 include, but are not limited to, synthetic or natural rubber, natural or synthetic elastomers (e.g., urethane, silicone, polyamide, polyester, thermoplastic elastomers, and the like), resins (e.g., thermoplastic resins), soft thermoplastic polymers (e.g., polyurethanes, polyesters, polyamides, and the like), textiles (e.g., elastomer or plastic reinforced textiles, woven or non-woven), laminated urethane, methane, vinylidene chloride, vinyl chloride, nylon, textiles, leather, and the like.

According to a separate aspect of the present invention, bladder member 104 can be formed from a material that is capable of sealing flowable medium 108 in and/or preventing the same from escaping from chamber 106. Depending on the type of flowable medium 108, the material of bladder member 104 can be selected accordingly to encase the particular flowable medium 108. For example, when a fluid medium 108 is used to fill chamber 106, bladder member 104 preferably is made of a fluid-tight material so that it can seal fluid medium 108 in a fluid-tight manner and prevent such medium 108 from inadvertently leaking out of chamber 106. In another embodiment, bladder member 104 can be formed of an air-tight material to retain a gaseous medium 108, such as ambient air, inside chamber 106.

The sealability of bladder member 104 can assist in preventing flowable medium 108 from escaping from chamber 106 and maintaining a continuous cushioning effect provided by flowable medium 108. In one embodiment, the sealability of bladder member 104 remains unchanged under all circumstances and regardless of whether bladder member 104 is being subjected to a deforming force. Accordingly, the same amount of flowable medium 108 can be held within chamber 106, even after cushioning device 100 is repeatedly subjected to deforming forces. Therefore, bladder member 104 can effectively maintain the internal pressure inside chamber 106 and thus the cushioning effect of flowable medium 108.

In an exemplary embodiment, bladder member 104 can be made of various resin and/or film products provided by the Dow Chemical Company under the trademark Saran. Saran resin and/or film products are capable of affording dependable oxygen and/or moisture barrier performance to thereby retain flowable medium 108 within chamber 106. For example, bladder member 104 can be formed of Saran resins and/or films, such as a polymer of vinylidene chloride and methyl acrylate, a polymer of vinylidene chloride, methacrylonitrile, and methyl methacrylate, a polymer of vinylidene chloride and acrylonitrile, and a copolymer of vinylidene chloride and vinyl chloride. Depending on its application, bladder member 104 can be in the form of either a monolayer or a multilayer. In one embodiment, bladder member 104 can comprise a Saran film sandwiched between a pair of urethane films forming a laminated or composite structure. The Saran film can be, for example, a copolymer of vinylidene chloride and vinyl chloride film marketed as Saran 100 HB Film. It will be appreciated that other suitable materials of bladder member 104 are also within the scope of the present invention.

It will be appreciated that the number, shape, and dimension of bladder member 104 can depend on the particular use of cushioning device 100 and can vary so long as it can provide a sufficient cushioning effect for the user. In one embodiment, a plurality of bladder members 104 can be formed on cushioning member 102. Each bladder member 104 can enclose a medium chamber 106, which can be either separated from or fluidly communicated with its adjacent chamber or chambers 106. In an exemplary embodiment, bladder members 104 define a plurality of sub-chambers or cells 106.

Bladder member 104 can have various shapes, such as an elongated shape, or a honey-comb shape, as shown in FIG. 4 or 6. In one embodiment, bladder members 104 can be so formed that chamber or sub-chambers 106 can assume shapes similar to that of bladder members 104. In the exemplary embodiments of FIGS. 1 to 5, elongated bladder members 104 can define elongated chambers or sub-chambers 106 therein. In another exemplary embodiment of FIG. 6, honey-comb shaped bladder members 104 can define chamber or sub-chambers 106 of a corresponding honey-comb shape. It will be appreciated that other shapes of bladder member 104 and/or chamber or sub-chambers 106 are also within the scope of the present invention.

Additionally or alternatively, bladder member 104 can have such a dimension that it is capable of assisting in stabilizing the inflated bladder member 104 after the same is subjected to a deforming force. For example, the inflated bladder member 104 can have a height (H) and a width (W) selected to effectively minimize the transverse or shear motions of bladder member 104.

In one embodiment, multiple bladder members 104 can be spaced from one another. Among other advantages, the spacing between adjacent bladder members 104 can allow the same to deform freely and thus to provide a sufficient cushioning effect for the user. Additionally or alternatively, the spacing can allow adjacent bladder members 104 to move either toward or away from each other so that bladder members 104 and cushioning member 102 can better conform to a curved surface. In an exemplary embodiment, as shown in FIG. 9, cushioning member with multiple bladder members 104 can be applied to a developable polygon. The shape of the article can enhance the spacing between the bladder members 104. The spaced or separated bladder members 104 can be advantageous in assisting in mounting cushioning member 102 onto a curved or multi-planar underlying article.

In another embodiment, as shown in FIG. 13, each bladder member 204 can comprise a raised portion 264 elevated from the major area of user contacting surface of cushioning member 202. Raised portion 264 can be spaced from adjacent raised portions 264. The spacing 266 between adjacent raised portions 264 can allow bladder member 204 to deform freely and thus to provide sufficient cushioning effect. In another embodiment, bladder member 204 can further comprise flange portions 268 extending from raised portion 264 and generally parallel to the major area of user contacting surface. In one embodiment, flange portions 268 can facilitate mounting of bladder member 204 on frame member 250. Additionally and alternatively, flange portions 268 can provide further cushioning effect to the user. It will be appreciated that other embodiments of bladder member 204 are within the scope of the present invention.

In addition to its features and functions as described above, bladder member 104 can assist flowable medium 108 in contributing to the comprehensive cushioning effect. For example, when flowable medium 108 is encased in bladder member 104, flowable medium 108 can freely flow within chamber 106 after being subjected to a deforming force to thereby provide a cushioning effect in addition to that afforded by bladder member 104.

Flowable medium 108 can be selected from a variety of materials, such as any solid, gel, liquid, or gaseous matter that can freely flow within chamber 106 when subjected to a deforming force. It will be appreciated that different types of flowable mediums 108 can afford different cushioning effects. For example, a fluid medium can freely flow within chamber 106 and provide a wide range of cushioning effect, from an impact absorption to a comfortable cushion. In one embodiment, the fluid can be a gaseous medium, such as ambient air, which provides a comfortable cushion, such as a comfortable finger grip, as will be described below.

The cushioning effect provided by flowable medium 108 can depend on other factors, such as internal pressure inside chamber 106. It will be appreciated that internal pressure inside chamber 106 can be determined by a number of factors, such as the type and the amount of flowable medium 108 in chamber 106, and can be of any value so long it can provide a desired cushioning effect. Generally, the internal pressure should not be so high that bladder member 104 fails to withstand the internal pressure and breaks down. Nor should the internal pressure be so high that the inflated bladder member does not deform sufficiently in response to a deforming force to provide a cushioning effect. On the other hand, the internal pressure should not be so low that the inflated bladder member 104 bottoms out when subjected to a deforming force.

When cushioning device 100 is intended to be used with a finger-held or finger-manipulated article 112, the internal pressure can be so selected that bladder member 104 can be deformed by the pressure exerted by the user's fingers or fingertips. In an exemplary embodiment, flowable medium 108 can be ambient air trapped in chamber 106 and encased by bladder member 104 during the manufacture of cushioning device 100 without further pressurizing chamber 106. Thus, no inflation mechanism or process is needed to prepare such cushioning device 100. In the resulting cushioning device 100, the internal pressure within chamber 106 would be substantially the same as ambient pressure. In another embodiment, flowable medium 108 can comprise a propellant matter in a liquid phase. Such propellant matter can evaporate and change into a gaseous state to increase the internal pressure inside chamber 106. Therefore, the resulting cushioning device 100 is capable of providing an enhanced cushioning effect.

Additionally or alternatively, flowable medium 108 can be a compressible fluid, such as compressible gels, liquids, and gases. Compressible medium 108 is capable of resuming the initial shape instantly after the release of the deforming force. Thus, cushioning device 100 is capable of providing a cushioning effect in response to a second deforming force applied immediately after the release of the first deforming force. Even if the second deforming force is applied to cushioning device 100 in the same manner as the prior deforming force, cushioning device 100 will not bottom out or fail to provide a cushioning effect to the second deforming force.

Other features and properties of flowable medium 108 can also affect its cushioning effect and/or general usability. For example, flowable medium 108 can be formed of a moderately viscous fluid which would modify the cushioning effect of flowable medium 108. Viscous medium 108 can be either miscible or immiscible fluid, such as the fluid used in lava lamps. Additionally or alternatively, flowable medium 108 can be a Newtonian fluid such that the feel of inflated bladder member 104 will not change over time. Additionally or alternatively, flowable medium 108 can be formed of a temperature or pressure sensitive medium to provide the user with additional variable feel during the use of cushioning device 100. Additionally or alternatively, flowable medium 108 can be a color changing fluid so as to afford the user variable visual effect. It will be appreciated that additional features and properties of flowable medium 108 can contribute to its cushioning effect, which are also within the scope of the present invention.

Exemplary manners of forming the cushioning device of the present invention will now be described. In the embodiments of FIGS. 1 to 3, cushioning device 100 can be formed as a cushioning member 102 and comprise a wall member 170 defining chamber 106 therein. Optionally, wall member 170 can comprise a pair of sheets 172, 174 defining chamber 106 therebetween, such as shown in FIGS. 2 and 3. The thickness and other characteristics of wall member 170 and/or sheets 172, 174 may be influenced by the specific application of cushioning device 100 and/or depend on how much impact cushioning device 100 is designed to sustain. It will be appreciated that the thickness of wall member 170 and/or sheets 172, 174 can be smaller for cushioning device 100 used to provide a comfortable grip than cushioning device 100 used for shock absorption.

First and second sheets 172, 174 can be separately formed and later joined together through conventional processes, such as ultrasonic, kinetic, or other form of welding, molding, heat sealing, adhesion (e.g., through application of any type of adhesive), mechanical couplings (e.g., fasteners, clamps, or sealing rings), or the like. In a preferred embodiment, first and second sheets 172, 174 can be joined to each other in a fluid-tight manner to prevent flowable medium 108 from escaping from chamber 106.

Figure 14:
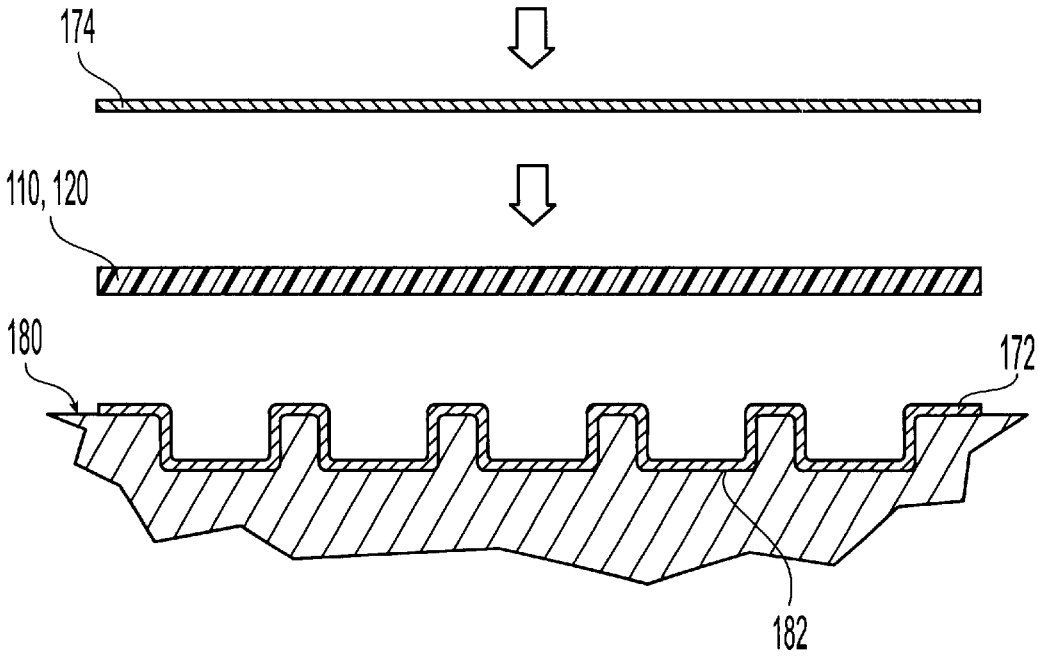
FIG. 14 shows the manufacture process of the cushioning device of FIG. 3.

In exemplary embodiments of FIG. 14, cushioning member 102 can be formed by joining first and second sheets 172, 174 together in a mold. For example, a mold member 180 can be employed which can have at least one cavity 182 formed therein. The molding cavity 182 can be contoured in accordance with the desired shape of final bladder member 104 and/or chamber 106. During the molding process, at least a portion of one of the first and second sheets, such as first sheet 172, can be placed on the mold member 180, over the molding cavity 182. The portion of the sheet over the molding cavity 182 is then made to conform to the contour of the molding cavity 182 and maintained in the conforming position by any conventional method. In an exemplary embodiment, a vacuum mechanism can be employed to achieve the desired deformation such as by applying a vacuum at the bottom of the molding cavity 182. Accordingly, the sheet portion over the molding cavity 182 can deform to at least partially define chamber 106 therein. Typically, the sheet is heated to facilitate deformation.

The other of the first and second sheets is laid on top of the deformed sheet to thereby define chamber 106 therebetween. First and second sheets 172, 174 can then be joined to each other to enclose chamber 106 by various conventional methods, such as welding or adhesion. For example, another mold member can be used to join first and second sheets 172, 174. In one embodiment, one or both of first and second sheets 172, 174 can be heated when they are being sealed to each other. It will be appreciated that other embodiments of joining first and second sheets 172, 174 are also within the scope of the present invention.

During or after the formation of cushioning member 102, flowable medium 108 can be filled in chamber 106 by various methods, such as by injection. In one embodiment, ambient air can be used as flowable medium 108 to inflate chamber 106 at various pressure levels depending on the particular application of cushioning device 100. In another embodiment, cushioning member 102 can be formed by enclosing the ambient air existing in chamber 106 during the manufacturing process. Accordingly, the resulting internal pressure inside chamber 106 is substantially the same as ambient pressure.

When insert member 120 is incorporated in cushioning device 100 for additional or modified cushioning effect, such insert member 120 can be placed between first and second sheets 172, 174 before joining the same. In the embodiment of FIG. 2, insert member 120 can be sized and shaped to conform to chamber 106 so as to be placed therein. Alternatively, insert member 120 can be in the form of a sheet sandwiched between first and second sheets 172, 174. Accordingly, when first and second sheets 172, 174 are joined to each other, insert member 120 can overlap and be joined to the sheets 172, 174. It will be appreciated that other embodiments of forming cushioning member 102 are also within the scope of the present invention.

In another embodiment, cushioning member 102 can be formed as a unitarily-formed member defining chamber 106 therein. The unitary cushioning member 102 can be formed, for example, through various conventional processes such as a molding process resulting in a simple, unitary wall forming the entire cushioning member 102. It will be appreciated that other embodiments of forming cushioning device 100 are also within the scope of the present invention.

Depending on the particular application, the cushioning device of the present invention can be shaped in various forms to meet the cushioning requirements of a user. For example, the cushioning device can be mounted onto an underlying article to provide a cushioning effect therefor. In an exemplary embodiment of FIGS. 1 to 3, cushioning device 100 can be used in connection with a generally planar surface on the underlying article. Accordingly, cushioning device 100 assumes a generally planar shape to provide a cushioning effect for a similar planar surface. In one embodiment, cushioning member 102 can take on a pad shape defining medium chamber 106 therein. Examples of pad-shaped cushioning devices 100 can include, but are not limited to, sports cushions (e.g., gym cushions and exercise mats) and body cushions (e.g., mattresses, pillows, back and seat cushions, knee pads, and helmet lines). In an exemplary embodiment, pad-shaped cushioning device 100 can be adapted to conform to both the generally planar surface on underlying article, such as the back support of a chair, and an ergonomic shape of a user's body portion, such as the user's back.

In an alternative embodiment, such as shown any of FIGS. 4 to 9 and 13, the underlying article can be either finger-held articles 112, such as writing implements, shavers, razors, toothbrushes, eating utensils, precision instruments, scissors, and the like, or hand-held articles 114, such as sports rackets, sports equipment handles (e.g., bicycle handles or motorcycle handles), steering wheels, cooking utensils, and tools (e.g., hammers). Cushioning device 100 can be constructed accordingly to conform to and/or fit over grip portion 118 on finger-held article 112 or hand-held article 114 to thereby provide a comprehensive cushioning grip to a user's fingers, finger-tips, or hand. In one embodiment, the planar cushioning member 102 of any of FIGS. 1 to 3 can be adapted to only partially wrap around finger-held article 112 or hand-held article 114 and be fixed or removably mounted thereon as described above. In another embodiment, cushioning member 102 can completely wrap around finger-held article 112 or hand-held article 114 and be fixed or removably mounted thereon in a similar manner or additional manners as described above.

The cushioning device of the present invention can be formed for various purposes. For example, the cushioning device can be used as a shock absorber or a comfortable cushion according to the magnitude of the deforming force applied thereto. For shock absorption purposes, the cushioning device in general and the bladder member in particular can be formed of a stronger material so as to withstand the impact. In addition, the internal pressure of the flowable medium and/or the resiliency of support element can be varied and adjusted accordingly to absorb the impact. To provide a comfortable cushion, on the other hand, the cushioning device and particularly the bladder member can be formed of a material that can present a user-friendly feel or contact. Additionally or alternatively, the support element and/or the internal pressure within the chamber can be selected and adjusted to provide a comfortable cushion for a user. In another embodiment, cushioning device of the present invention can be constructed as a self-contained unit, such as toys and stress relievers. Cushioning device can thus assume various shapes, such as various geometry (e.g., cubic, ball, oval, etc.) shapes, animal or cartoon configurations, or other regular or irregular shapes. It will be appreciated that other applications of the cushioning device are also within the scope of the present invention.

It will be appreciated that the various features described herein may be used singly or in any combination thereof. Therefore, the present invention is not limited to only the embodiments specifically described herein. While the foregoing description and drawings represent a preferred embodiment of the present invention, it will be understood that various additions, modifications, and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiment is therefore to be considered in all respects as illustrative and not restrictive, the scope of the invention being indicated by the appended claims, and not limited to the foregoing description.

What is claimed is:

1. A cushioning device comprising:

a cushioning member comprising a deformable bladder member at least partially defining a fluid chamber therein and a flowable fluid enclosed in said fluid chamber in a fluid-tight manner, said bladder member and said flowable fluid each being capable of providing a cushioning effect in response to a deforming force; and a support element formed separately from said bladder member and positioned with respect to said bladder member to modify the cushioning effect of at least one of said bladder member and said flowable fluid;

wherein one of said bladder member and said support element is adapted to mount said cushioning member at least partially around a finger-manipulable article;

whereby said deformable bladder member, said flowable fluid, and said support element are capable of providing a comprehensive cushioning effect for the fingers of the user.

2. The cushioning device of claim 1, wherein said support element comprises a resilient material.

3. The cushioning device of claim 1, wherein said support element comprises an insert member positioned inside said chamber and adapted to deform when said bladder member is subjected to a deforming force.

4. The cushioning device of claim 3, wherein said insert member is shaped to substantially fill said chamber.

5. The cushioning device of claim 3, wherein said insert member comprises an open-cell foam.

6. The cushioning device of claim 3, wherein said insert member comprises a thermoplastic material.

7. The cushioning device of claim 1, wherein said support element comprises an external member positioned outside said chamber.

8. The cushioning device of claim 7, wherein:

said cushioning member has a pad shape before being mounted onto the article to be held by the user and comprises first and second joining portions configured to be joined together for mounting said cushioning member on the article; and said external member comprises a seal member formed by overlapping and connecting said joining portions.

9. The cushioning device of claim 7, wherein said external member is positioned to contact at least a portion of said bladder member and is less deformable than said cushioning member to minimize transverse movement of said bladder member.

10. The cushioning device of claim 9, wherein:

said external member comprises a barrel member defining at least one aperture through which said bladder member extends; and said cushioning element is configured to fit within said barrel member so that said bladder member extends through said aperture.

11. The cushioning device of claim 7, wherein said external member is spaced away from said bladder member so that said external member provides an independent cushioning effect from that of said bladder member and said flowable fluid.

12. The cushioning device of claim 7, wherein at least a portion of said external member is contoured to conform to a portion of the user's hand.

13. The cushioning device of claim 7, wherein said external member is adapted to mount said cushioning member onto the article.

14. The cushioning device of claim 1, wherein said cushioning member wraps around at least a portion of the article and is thereby mounted thereon during the ordinary use of the article.

15. The cushioning device of claim 14, wherein said cushioning member is a tubular member for mounting onto an elongated article.

16. The cushioning device of claim 1, wherein said cushioning member comprises a plurality of bladder members spaced apart from each other.

17. The cushioning device of claim 1, wherein said chamber is divided into a plurality of honeycomb-shaped sub-chambers.

18. The cushioning device of claim 1, wherein said fluid in said chamber has a pressure of about the same as ambient pressure.

19. The cushioning device of claim 1, wherein said fluid is a gas.

20. A cushioned article comprising a finger-held article and a cushioning device being mounted on said finger-held article, said cushioning device comprising:

a deformable bladder member at least partially defining a chamber therein, said bladder member being sized to fit within a user's finger grip; and a gaseous medium enclosed in said chamber in a gas-tight manner and in an amount so that said bladder member is deformable under the pressure applied by the user's fingers;

whereby said cushioning device can provide a comfortable grip on said finger-held article for the user's fingers.

21. The cushioned article of claim 20, further comprising a support element positioned with respect to said bladder member and providing a cushioning effect different from that of said bladder member and said medium.

22. The cushioned article of claim 20, wherein said finger-held article is selected from the group consisting of: writing implements, shavers, razors, toothbrushes, eating utensils, precision instruments, and scissors.

23. A cushioning device comprising:

a cushioning member comprising a deformable bladder member at least partially defining a fluid chamber therein and a flowable fluid enclosed in said fluid chamber in a fluid-tight manner, said bladder member and said flowable fluid each being capable of providing a cushioning effect in response to a deforming force; and an external member positioned outside said fluid chamber to modify the cushioning effect of at least one of said bladder member and said flowable fluid;

wherein:

one of said bladder member and said support element is adapted to mount said cushioning member to an article to be held by a user;

said cushioning member has a pad shape before being mounted onto the article to be held by the user and comprises first and second joining portions configured to be joined together for mounting said cushioning member on the article; and said external member comprises a seal member formed by overlapping and connecting said joining portions;

whereby said deformable bladder member, said flowable fluid, and said support element are capable of providing a comprehensive cushioning effect for the user.

24. A cushioning device comprising:

a cushioning member comprising a deformable bladder member at least partially defining a fluid chamber therein and a flowable fluid enclosed in said chamber in a fluid-tight manner, said bladder member and said flowable fluid each being capable of providing a cushioning effect in response to a deforming force; and a barrel member positioned outside said fluid chamber to modify the cushioning effect of at least one of said bladder member and said flowable fluid;

wherein:

said barrel member defines at least one aperture through which said bladder member extends;

said cushioning element is configured to fit within said barrel member so that said bladder member extends through said aperture; and one of said bladder member and said barrel member is adapted to mount said cushioning member to an article to be held by a user;

whereby said deformable bladder member, said flowable fluid, and said barrel member are capable of providing a comprehensive cushioning effect for the user.

25. A cushioned article comprising:

an article configured to receive a cushioning member; and a cushioning member mounted on said article and comprising:

a deformable bladder member at least partially defining a fluid chamber therein and a flowable fluid enclosed in said fluid chamber in a fluid-tight manner, said bladder member and said flowable fluid each being capable of providing a cushioning effect in response to a deforming force; and an external member positioned outside said fluid chamber, said external member being more rigid than the bladder member to stabilize said bladder member from shifting;

whereby said deformable bladder member, said flowable fluid, and said support element are capable of providing a comprehensive cushioning effect for the user.

26. A cushioning device comprising:

a cushioning member comprising a deformable bladder member at least partially defining a fluid chamber therein and a flowable fluid enclosed in said chamber in a fluid-tight manner, said bladder member and said flowable fluid each being capable of providing a cushioning effect in response to a deforming force; and a rigid external member placed away from said bladder member so that said external member provides an independent cushioning effect from that of said bladder member and said flowable fluid;

wherein one of said bladder member and said support element is adapted to mount said cushioning member to an article to be held by a user;

whereby said deformable bladder member, said flowable fluid, and said support element are capable of providing a comprehensive cushioning effect for the user.

* * * * *